US006414232B2

(12) United States Patent
Ikeya

(10) Patent No.: US 6,414,232 B2
(45) Date of Patent: Jul. 2, 2002

(54) TONE GENERATION METHOD AND APPARATUS BASED ON SOFTWARE

(75) Inventor: Tadahiko Ikeya, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/887,406

(22) Filed: Jun. 21, 2001

(30) Foreign Application Priority Data

Jun. 22, 2000 (JP) ..... 2000-187176

(51) Int. Cl.[7] ..... G10H 7/00; G10H 1/06

(52) U.S. Cl. ..... 84/604; 84/618; 84/622; 84/625

(58) Field of Search ..... 84/625, 660, 615, 84/618, 653, 656, 604, 622, 659

(56) References Cited

U.S. PATENT DOCUMENTS 5,696,342 A 12/1997 Shimizu
5,728,961 A * 3/1998 Tamura ..... 84/603 X
5,770,812 A * 6/1998 Kitayama ..... 84/603
5,913,258 A * 6/1999 Tamura ..... 84/604
5,973,251 A * 10/1999 Mukojima et al. ..... 84/603
5,981,860 A * 11/1999 Isozaki et al. ..... 84/603
6,184,455 B1 * 2/2001 Tamura ..... 84/625
6,140,566 A1 * 10/2001 Tamura

FOREIGN PATENT DOCUMENTS

EP 0775996 5/1997
JP 09-325778 12/1997

* cited by examiner

*Primary Examiner*—Jeffrey Donels
(74) *Attorney, Agent, or Firm*—Morrison & Foerster LLP

(57) ABSTRACT

Arithmetic processor executes waveform generation software on the basis of a received tone generation instruction, to thereby generate tone waveform data in a plurality of channels. The tone waveform data generated in the plurality of channels are added together so to be output as tone waveform data for a track. At the same time, waveform data are previously generated for a plurality of channels so as to be output at a time later than the current time point, and the waveform data thus previously generated in the plurality of channels are added together so that they are stored in a buffer storage section as previously-generated tone waveform data for a track. When there has occurred a situation that prevents waveform generation, the previously-generated waveform data currently stored in the buffer storage section are output.

15 Claims, 8 Drawing Sheets

TONE GENERATION METHOD AND APPARATUS BASED ON SOFTWARE

BACKGROUND OF THE INVENTION

The present invention relates to tone generation methods for generating tones by running predetermined software on arithmetic processing apparatus.

Tone generation methods have been known which are designed to generate tones by running predetermined software on general-purpose arithmetic processing apparatus such as a CPU. These tone generation schemes are commonly called "software tone generators". In the software tone generators, a tone generation program is executed at predetermined time intervals to generate tones for a plurality of channels based on given tone control data.

Conventional real-time systems implementing the software tone generators, however, would often present the problem that a generated tone is undesirably broken or noise is produced when waveform formation has been disabled or prevented, for example, due to excessively-increased loads on the arithmetic processor.

Further, in a situation where performance data can not be processed at generation timing or input timing of the data due to excessively-increased loads on the arithmetic processor or the like, the performance data would be left unprocessed at all or, if processed later, unnatural tone control would result.

SUMMARY OF THE INVENTION

In view of the foregoing, it is an object of the present invention to provide a tone generation method and apparatus which can reliably avoid an undesired break in a waveform output or noise production even when waveform formation has been disabled or prevented due to excessively-increased loads on a processor or other reason.

In order to accomplish the above-mentioned object, the present invention provides a tone generation method for implementation by use of an apparatus including a processor that executes software, a storage section storing waveform generation software to be executed by the processor, and a buffer storage section that stores waveform data generated by execution of the waveform generation software, which comprises: a step of receiving a tone generation instruction; a step of causing the processor to execute the waveform generation software on the basis of the received tone generation instruction, to thereby not only generate and output waveform data but also previously generate waveform data to be output later than a current time point; a step of storing, into the buffer storage section, the waveform data generated previously via the step of causing; a step of, when there has occurred a situation that disables or prevents waveform generation, outputting the previously-generated waveform data currently stored in the buffer storage section; a step of waiting execution of the tone generation instruction, when there has occurred a situation that disables or prevents previous generation of waveform data based on the tone generation instruction; and a step of generating waveform data based on the tone generation instruction waited by the step of waiting, when the generation of waveform data based on the tone generation instruction becomes possible later.

The present invention also provides a tone generation method for implementation by use of an apparatus including a processor that executes software, a storage section storing waveform generation software to be executed by the processor, and a buffer storage section that stores waveform data generated by execution of the waveform generation software, which comprises: a step of receiving a tone generation instruction; a step of causing the processor to execute the waveform generation software on the basis of the received tone generation instruction, to thereby not only generate and output waveform data but also previously generate waveform data to be output later than a current time point; a step of storing, into the buffer storage section, the waveform data generated previously via the step of causing; and a step of generating waveform data for current and subsequent time points on the basis of the received tone generation instruction and adding the generated waveform data for the current and subsequent time points to the waveform data generated previously via the step of causing and stored in the buffer storage section.

According to another aspect of the present invention, there is provided a tone generation method for implementation by use of an apparatus including a processor that executes software, a storage section storing waveform generation software to be executed by the processor, and a buffer storage section that stores waveform data generated by execution of the waveform generation software, which comprises: a step of receiving a tone generation instruction; a step of causing the processor to execute the waveform generation software on the basis of the received tone generation instruction, thereby generating waveform data in a plurality of channels, and mixing the waveform data, generated in the plurality of channels, on a track-by-track basis to thereby output the mixed waveform data for each of the tracks; a step of previously generating waveform data for a plurality of channels to be output later than a current time point and mixing the waveform data, previously generated in the plurality of channels, on a track-by-track basis to thereby store, into the buffer storage section, the mixed waveform data for each of the tracks; and a step of, when there has occurred a situation that prevents waveform generation, outputting the previously-generated waveform data currently stored in the buffer storage section.

The inventive tone generation method may further comprise a step of receiving track control data so that the waveform data for each of the tracks stored in the buffer storage section are controlled on the basis of the track control data.

The step of previously generating waveform data may previously generate the waveform data on the basis of a previously-received tone generation start instruction.

Further, the step of previously generating waveform data may previously generate the waveform data on the basis of musical composition data to be automatically performed.

Furthermore, in the tone generation based on the waveform generation software, a current time and a tone-generation starting time may be compared so that waveform data starting with an attack portion of a tone are generated when a time delay of the current time from the tone-generation starting time is smaller than a predetermined value, but waveform data starting with a sustain portion of the tone are generated when the time delay of the current time from the tone-generation starting time is greater than a predetermined value.

The present invention may be constructed and implemented not only as the method invention as discussed above but also as an apparatus invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, not to mention a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which.

DETAILED DESCRIPTION OF EMBODIMENTS

Figure 1:
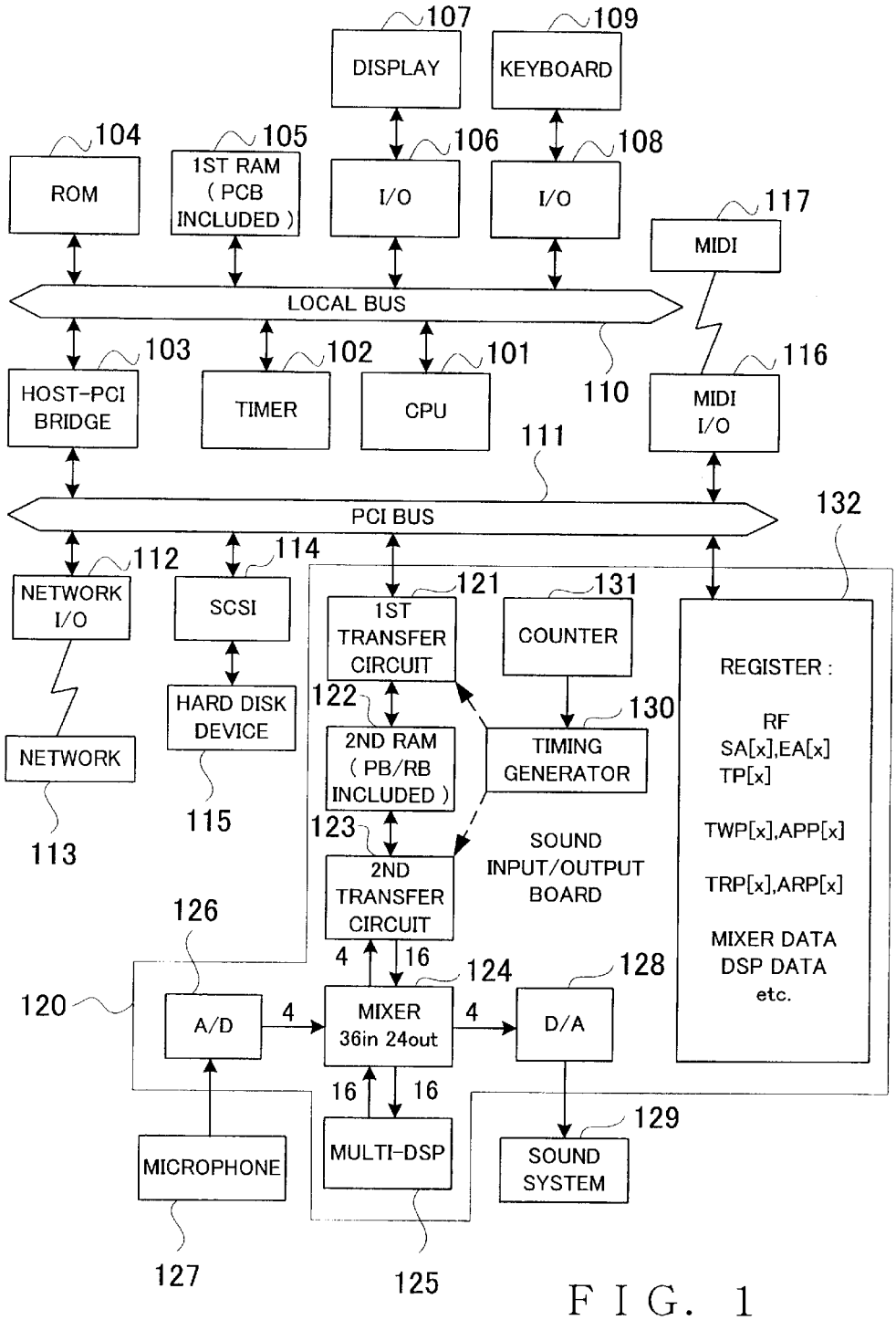
FIG. 1 is a block diagram showing an exemplary setup of an electronic musical instrument to which is applied a tone generation method in accordance with an embodiment of the present invention.

FIG. 1 is a block diagram showing an exemplary setup of an electronic musical instrument to which is applied a tone generation method in accordance with an embodiment of the present invention. As shown, this electronic musical instrument includes a central processing unit (CPU) 101, a timer 102, a host-PCI (acronym for Peripheral Component Interconnect) bridge 103, a read-only memory (ROM) 104, a random-access memory (RAM) 105, a display input/output (I/O) interface 106, a display device 107, a keyboard I/O interface 108, a keyboard 109, a local bus 110, a PCI bus 111, a network I/O interface 112, a SCSI (acronym for Small Computer System Interface) 114, a hard disk device 115, a MIDI (acronym for Musical Instruments Digital Interface) I/O interface 116, and a sound input/output board 120.

The CPU 101 controls various operations of the entire electronic musical instrument. The timer 102 generates timer interrupt signals at predetermined time intervals. The host-PCI bridge 103 controls transfer of various signals or data between the local bus 110 connecting the CPU 101 and memories and the PCI bus 111 connecting peripheral equipment. The ROM 104 is a storage device having stored therein a BIOS (Basic Input/Output System) and the like. The RAM 105 is a storage device into which a program to be executed by the CPU 101 is loaded and which includes various buffer areas as will be later described. Among the various buffer areas in the RAM 105 is a "PC" buffer ("PCB" in the figure) for use as a reproducing buffer (to be described later). The display device 107 displays various data received via the display I/O interface 106. The keyboard 109 is a typing keyboard 108 that is used for a user to enter various information. The user can use the keyboard 109 and display device 107 to perform various setting and instructing operations with respect to the electronic musical instrument. The local bus 110 may be composed of two buses: a dedicated bus of the CPU 101; and a local PCI bus for connecting peripheral I/Os and the like.

Various peripheral equipment is connected to the PCI bus 111, and the PCI bus 111 in turn can be connected to an external network 113 via the network I/O interface 112. To the PCI bus 111 is also connected the hard disk device 115 via the SCSI 114. The sound input/output board 120 includes a transfer circuit 121, a RAM 122, a transfer circuit 123, a mixer 124, a multi-DSP (Digital Signal Processor) 125, an analog-to-digital (A/D) converter 126, a digital-to-analog (D/A) converter 128, a timing generator 130, a counter 131, and a group of registers 132. As depicted in FIG. 1, the RAM 105 will hereinafter be referred to as a "first RAM", the transfer circuit 121 as a "first transfer circuit", the RAM 122 as a "second RAM", and the transfer circuit 123 as a "second transfer circuit".

The first transfer circuit 121 is a circuit that uses the PCI bus 111 in the so-called "burst" manner to collectively transfer a plurality of tone waveform samples to the second RAM 122 at high speed. The second RAM 122 includes a "P" buffer ("PB" in the figure) for use as a reproducing buffer, and an "R" buffer ("R" in the figure) for use as a recording buffer. These P and R buffers are provided in corresponding relation to a plurality of reproducing tracks (four reproducing tracks in the illustrated example). The P buffer for each of the tracks is constructed as a so-called "double buffer" consisting of two buffer storage sections. In the P buffer for each of the tracks, once one of the buffer storage sections gets empty, transfer of tone waveform samples to the one buffer storage section is started via the first transfer circuit 121, at which time the other buffer storage section is used to output tone waveform samples therefrom via the second transfer circuit 123. The sample output via the second transfer circuit 123 is carried out in succession per sampling period. More specifically, the second transfer circuit 123 has a function of transferring tone waveform samples from the P buffer of the second RAM 122 to a mixer 124 or transferring recording samples, output from the mixer 124, to the R buffer of the second RAM 122. The transfer of the recording samples to the R buffer too is carried out per sampling period. The second RAM 122 is accessed by the first and second transfer circuits 121 and 123 on a time-divisional basis. For example, each digital-to-analog conversion (DAC) cycle (e.g., 44.1 kHz) during reproduction or recording is divided into halves so that the first half of the DAC cycle is used by the first transfer circuit 121 while the second half of the DAC cycle is used by the second transfer circuit 123.

Note that the access, by the first transfer circuit 121, to the reproducing P buffer and recording R buffer of the second RAM 122 has priority over the access, by the CPU 101, to the same buffers. Namely, in a situation where the reproducing P buffer or recording R buffer is being accessed by the CPU 101 when the first transfer circuit 121 is about to access the same buffer, the access by the CPU 101 is interrupted so as to allow the first transfer circuit 121 to access the buffer with priority over the CPU 101. However, because the sample transfer operation by the first transfer circuit 121 is invariably ceased or deactivated in the second half time period of each of the DAC cycles during reproduction or recording, the CPU 101, at the worst, can access the buffer using the remaining time period of each of the DAC cycles.

The first and second transfer circuits 121 and 123 carry out the tone waveform sample transfer in accordance with timing signals output from the timing generator 130. The timing generator 130 generates such timing signals in accordance with count outputs from the counter 131. The registers 132 include registers for retaining various data such as transfer addresses.

The mixer 124 includes 36 input terminals and 24 output channels, and it can mix input signals received via selected ones of the input terminals and pass the mixed results to selected ones of the output terminals. Which of the inputs should be used to generate output signals and via which of the output terminals the generated output signals should be output can be instructed via the CPU 101. The multi-DSP 125, where a plurality of microprograms are run, performs various processes, such as an effect impartment process, on selected tone waveform samples. External microphone 127 is connected to the A/D converter 126. The A/D converter 126 receives an external sound picked up via the microphone 127, converts the received sound into digital data, and passes the converted digital data to the mixer 124. Tone waveform output from the mixer 124 is subjected to digital-to-analog conversion and then audibly reproduced or sounded through a sound system 129 including amplifiers and speakers. Various components associated with the mixer 124 and provided at stages following the second transfer circuit 123 are caused to operate in processes performed for each sampling cycle.

In the illustrated example, the CPU 101 carries out tone waveform formation processing for 16 channels, combines or compiles the generated tone waveform data for the 16 channels into four tracks in the first RAM 105, and transfers the four-track tone waveform data to the second RAM 123 by way of the first transfer circuit 121. More specifically, the PC buffers are provided, in the first RAM 105, in corresponding relation to the four tracks, and the tone waveform data for the 16 channels are compiled into the PC buffers corresponding to the four tracks. Then, the tone waveform data thus stored in the PC buffers corresponding to the four tracks are transferred, via the first transfer circuit 121, to the reproducing P buffers provided in the second RAM 122 in corresponding relation to the four tracks. The tone waveform data thus temporarily stored in the P buffers corresponding to the four tracks are passed to the mixer 124 via the second transfer circuit 123. Although the mixer 124 is capable of receiving 16-channel data from the second transfer circuit 123, it only uses 4-channel data in the illustrated example.

Figure 10:
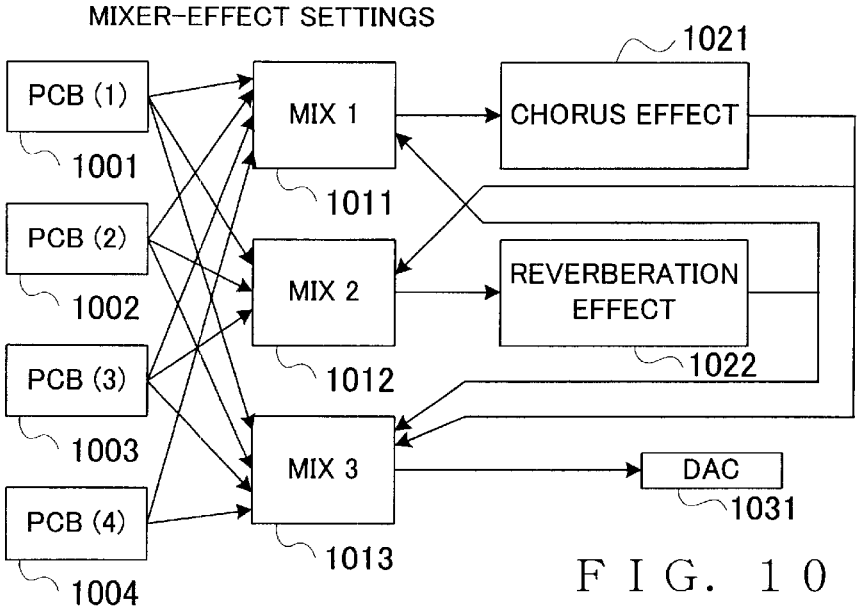
FIG. 10 is a block diagram showing an example of mixer-effect settings made in the embodiment of the present invention.

FIG. 10 is a block diagram showing an example of mixer-effect settings made by the mixer 124 and the DSP 125. Reference numerals 1001–1004 represent the PC buffers provided in the first RAM 105 in corresponding relation to the four tracks. Tone waveform signal temporarily stored in each of the PC buffers 1001–1004 is passed to the mixer 124 by way of the first transfer circuit 121, P buffer of the second RAM 122 and second transfer circuit 123. Reference numerals 1011–1013 represent three separate mixing sections set in the mixer 124. Chorus effect section 1021 and reverberation effect section 1022 are both effect impartment circuits implemented by the DSP 125. DAC section 1031 corresponds to the D/A converter 128. Because the mixer 124 has a sufficient number of output channels, the illustrated example of FIG. 10 can process signals on individual signal lines, separately as left-channel and right-channel stereophonic signals.

The following paragraphs briefly describe various registers, data and the like employed in the instant embodiment. Note that subscript "x" in square brackets imparted to alphabetical signs of the registers represents a track number.

(a) SA[x]: Register for storing a start address of the reproducing PC buffer provided in the first RAM 105.

(b) EA[x]: Register for storing an end address of the reproducing PC buffer provided in the first RAM 105.

(c) TP[x]: Register (address counter) for storing a read address of the PC buffer when waveform data are to be read out from the PC buffer and transferred to the P buffer provided in the second RAM 122.

(d) TWP[x]: Register (address counter) for storing a write address of the P buffer provided in the second RAM 122 when waveform data read out from the PC buffer are to be transferred and written into the P buffer.

(e) APP[x]: Register (readout counter) for storing a read address when waveform data are to be read out from the P buffer in the sampling cycles and passed to the mixer 124.

(f) Mixer Data: Data to be set into the mixer 124. This mixer data defines a mixing ratio among data of 16 tracks, a mixing ratio among data of four tracks given from the A/D converter 126, a mixing ratio among data of 16 tracks given from the DSP 125, etc.

(g) DSP Data: Data to be set into the DSP 125. This DSP data defines microprograms to be run by the DSP 125 and input/output relationship, etc.

Also, note that the alphabetical signs of the registers and the like each represent not only a storage location but also the data stored in the storage location. For example, "SA[x]" represents the start-address storing register, as well as the data at the start address stored in the register.

Figure 2:
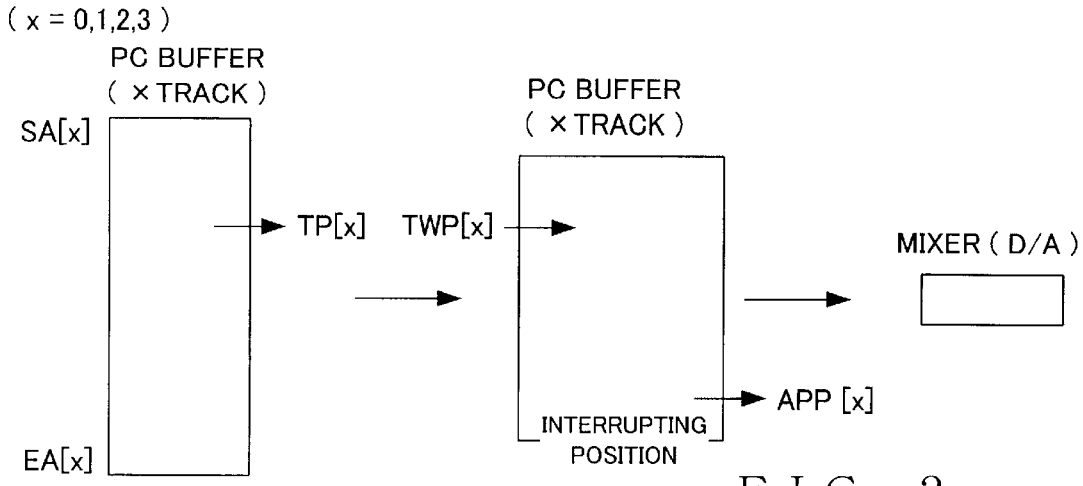
FIG. 2 is a block diagram showing an exemplary general organization of reproducing buffers and an exemplary data flow through the reproducing buffers in the embodiment.

FIG. 2 is a block diagram showing an exemplary general organization of the reproducing buffers and an exemplary data flow through the reproducing buffers. As note earlier, for the waveform reproducing purposes, the first RAM 105 includes the PC buffers corresponding to the four tracks, and the second RAM 122 includes the P buffers also corresponding to the four tracks. A description is given below about how the reproducing buffer for one track x (x=0, 1, 2 or 3) is used in the instant embodiment. Each of the PC buffers in the first RAM 105 ranges from the start address SA[x] to the end address EA[x]. Any desired start address SA[x] and end address EA[x] can be designated by the CPU 101, and thus the PC buffer can be placed in a desired position of the first RAM 105. Further, each of the reproducing PC buffers in the first RAM 105 can be set to any desired size. The CPU 101 previously generates waveform data corresponding to a plurality of time frames and stores the thus previously-generated waveform data into the PC buffer. TP[x] represents an address in the PC buffer with which the first transfer circuit 1 starts the waveform data transfer to the P buffer of the second RAM 122.

The waveform data transferred from the address TP[x] of the PC buffer are written into the write address TWP[x] of the P buffer of the second RAM 122. The P buffer of the second RAM 122 consists of two buffer storage sections each capable of storing therein 128 samples of the waveform data; however, the size of the P buffer may be chosen optionally. The waveform data thus stored in the P buffer are read out from the read address APP[x] of the P buffer and then passed to the mixer 124. Interrupting positions are set at the middle and trailing end of each of the P buffers. When the read address APP[x], which is incremented every sampling cycle to read out the waveform samples, arrives at the interrupting position, it means that one of the halves of the P buffer, being currently read, has got empty, and thus there is generated a hardware interrupt signal to trigger waveform formation processing. In response to the hardware interrupt, the CPU 101 transfers predetermined tone waveform data to be next reproduced, to the current empty half of the P buffer.

Note that for a real-time performance, it is necessary to restrict a time interval from a time point of performance input to a time point of tone output to about 10 msec. Where the sampling frequency is 44.1 kHz, 10 msec. corresponds to 441 samples. Generally, in software tone generators, there would occur a time delay in the order of two frames. Thus, in the instant embodiment, each frame is set to 128 samples; that is, the total size of the P buffer is chosen to be able to store 256 (i.e., 128×2) samples at a time.

In the PC buffer, there is stored previously-generated tone waveform data. As the number of the tone waveform samples capable of being pre-stored in the PC buffer, noise production in the software generator can be prevented more effectively. Thus, in the instant embodiment, the PC buffer has a size of, for example, 64 frames (128×64 samples=8 k samples).

Figure 3:
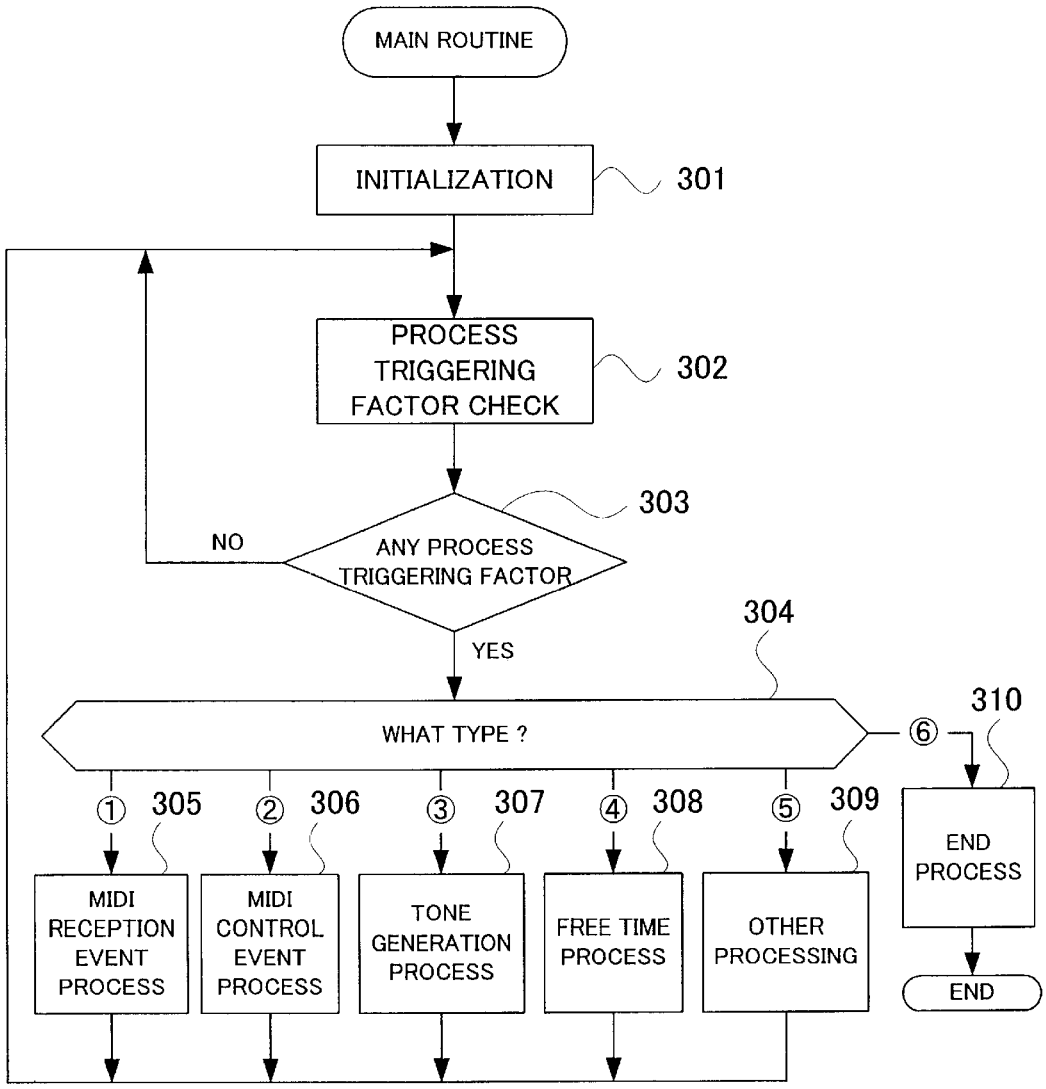
FIG. 3 is a flow chart showing an exemplary step sequence of a main routine of a control program for execution in relation to a software tone generator according to the present invention.

FIG. 3 is a flow chart showing an exemplary step sequence of a main routine of a control program that is executed by the CPU 101 in relation to the software tone generator. This main routine is previously registered, in the operating system, as a driver for the software tone generator. For tone generation using the software tone generator, this driver, i.e. the main routine processing of FIG. 3, is started up in order to activate an API (Application Programming Interface) associated with the software tone generator.

In FIG. 3, various necessary initialization operations are first carried out at step 301, where the above-mentioned PC and P buffers are cleared or set to predetermined initial settings. At next step 302, a determination is made as to whether there has occurred any cause or factor triggering a given process. If answered in the affirmative at step 303, the main routine proceeds to step 304, while if answered in the negative, the main routine revers to step 302. The operations at steps 302 to 304 for receiving such a process triggering factor correspond to reception of an instruction to the API associated with the software tone generator.

At step 304, a particular type of the process triggering factor having occurred is identified, and the main routine branches to a different step in accordance with the identified type of the process triggering factor. In the illustrated example, such a process triggering factor occurs ① when MIDI data (MIDI-I/O interrupt) has been received, ② when MIDI data is present in a MIDI data storing buffer (hereinafter "M buffer") of the first RAM 105, ③ when tone generation processing has been completed for one frame (i.e., 128 samples), i.e. when waveform data readout and reproduction has been completed in relation to either one of the two buffer storage sections of the P buffer (P buffer interrupt), ④ when there is free time, ⑤ when a given switch or the like has been activated, ⑥ when an end button has been clicked. The following paragraphs describe in detail each process that is activated in the embodiment in response to any one of the above-listed process triggering factors.

If MIDI data has been received via the MIDI interface 116 (process triggering factor ①) as determined at step 304, a MIDI event process is performed at step 305, after which the main routine reverts to step 302. The MIDI data reception and the MIDI event process of step 305 correspond to reception of performance input data. If MIDI data is present in the M buffer (process triggering factor ②) as determined at step 304, a MIDI control event process is performed at step 306, after which the main routine reverts to step 302.

If a frame interrupt has occurred (waveform data readout and reproduction for one frame has been completed) (process triggering factor ③), a tone generation process is performed at step 307, after which the main routine reverts to step 302. The frame interrupt is a hardware interrupt generated each time reproduction for one frame has been completed. In the tone generation process, waveform data of one frame (i.e., the number of waveform samples corresponding to half the size of the P buffer) are generated and written into the PC buffer.

If there is free time, i.e. there is no other process to be executed, (process triggering factor ④) as determined at step 304, a free time process is performed at step 308, after which the main routine reverts to step 302. If the given switch or the like has been activated (process triggering factor ⑤) as determined at step 304, other processing is performed at step 309, after which the main routine reverts to step 302. Further, if the end button has been clicked (process triggering factor ⑥) as determined at step 304, an end process is performed at step 310, after which the main routine reverts to step 302.

Note that in the instant embodiment, the above-mentioned process triggering factors ①–⑥ are prioritized as "①>③>②>⑤>⑥>④"; that is, process triggering factor ① is given the highest priority, and process triggering factor ④ the lowest priority.

Figure 4:
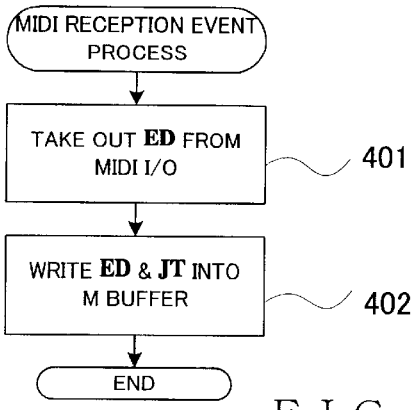
FIG. 4 is a flow chart showing an exemplary step sequence of a MIDI reception event process shown in FIG. 3.

FIG. 4 is a flow chart showing an exemplary step sequence of the MIDI reception event process of step 305 shown in FIG. 3. At step 401 of this MIDI reception event process, received event data ED is taken out from the MIDI interface 116. Then, at step 402, the event data ED and reception time JT of the event data ED are written into the M buffer, after which the MIDI reception event process is brought to an end.

Figure 5:
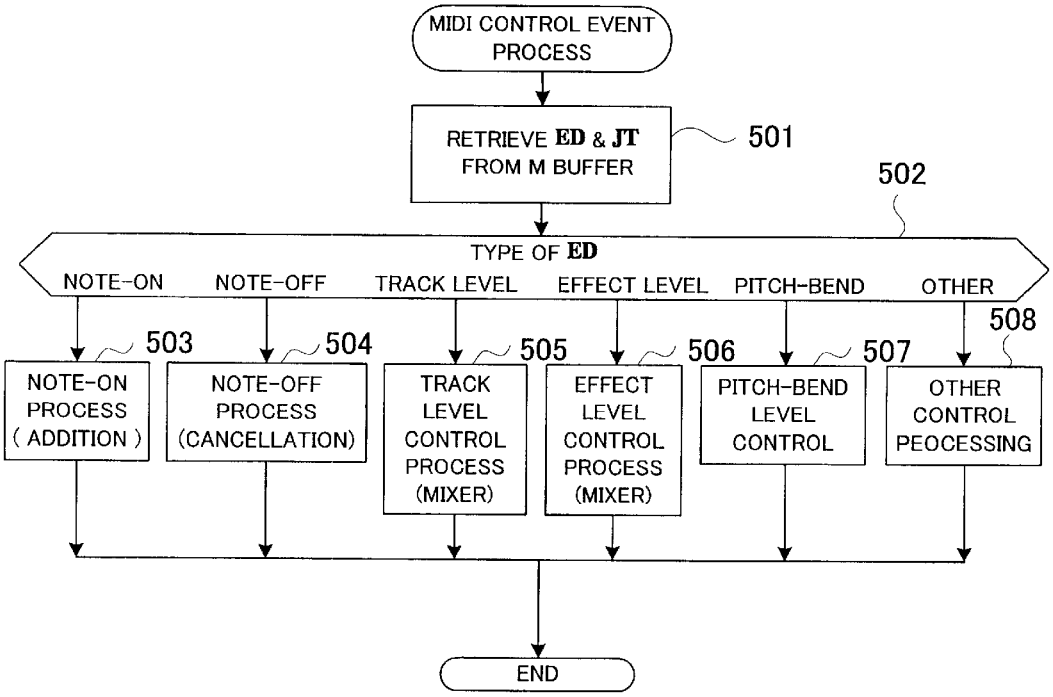
FIG. 5 is a flow chart showing an exemplary step sequence of a MIDI control event process shown in FIG. 3.

FIG. 5 is a flow chart showing an exemplary step sequence of the MIDI control event process of step 306 shown in FIG. 3. At step 501 of this MIDI control event process, the event data ED and reception time JT of the event data ED are retrieved from the M buffer. Then, at step 502, the MIDI control event process branches in accordance with the data type of the event data ED. Namely, if the event data ED is note-on event data, the MIDI control event process goes to step 503 to carry out a note-on process. If the event data ED is note-off event data, however, a note-off process is carried out at step 504. If the event data ED is track level data, a track level control process is carried out at step 505. If the event data ED is effect level data, an effect level control process is carried out at step 506. Further, if the event data ED is pitch event data, a pitch-bend level control process is carried out at step 507. Further, if the event data ED is other data than the above-mentioned, other control processing is carried out at step 508. After completion of any one of the processes at step 503–508 above, the MIDI control event process is brought to an end.

The above-mentioned processes of steps 503 to 507 can be classified broadly into the following three types, type 1 process to type 3 process. The type 1 process is the note-on process, and the type 1 process adds, to the previously-generated tone waveform data stored in the PC buffer, a tone waveform that is to newly start sounding. The type 2 process consists of the note-off process, pitch-bend level control process, and vibrato level process (included in the other control processing of step 508). The type 2 process is for discarding the previously-generated tone waveform and re-generate a tone waveform. The type 3 process consists of the track level control process, effect level control process, and effect change process (included in the other control processing of step 508). In the type 3 process, there is no need to add any change whatsoever to the previously-generated tone waveform itself. By appropriately changing the mixing ratio to be set in the mixer 124, it is possible to control track-specific tone volumes and effect levels; in this case, track control data are used to control the track-specific tone volumes and effect levels. Changing the programs to be used by the DSP 125 can make an effect change.

Figure 6:
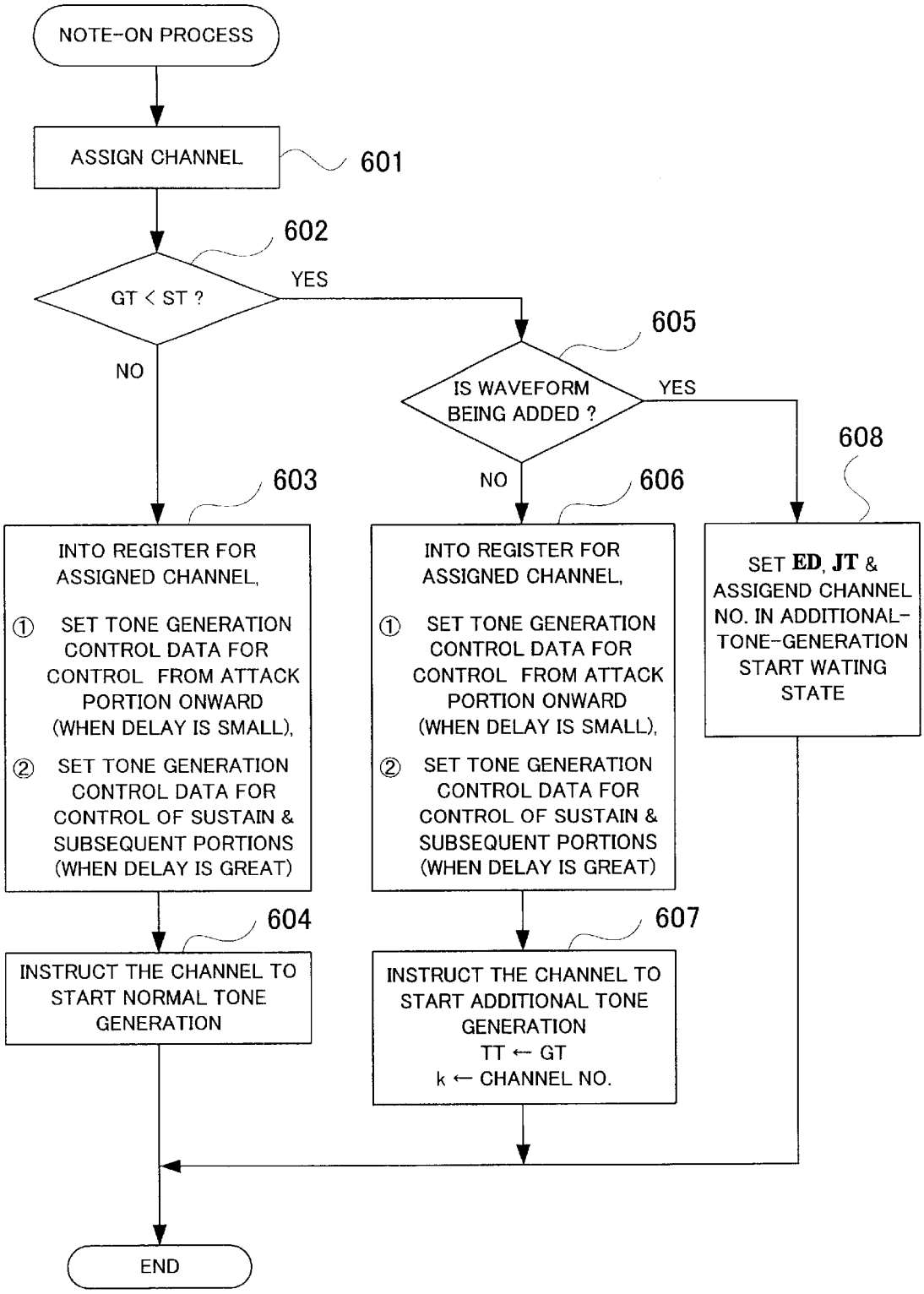
FIG. 6 is a flow chart showing an exemplary step sequence of a note-on process shown in FIG. 5.

FIG. 6 is a flow chart showing an exemplary step sequence of the note-on process of step 503 shown in FIG. 5. When the note-on process is started up or triggered, the event data ED and reception time JT of the event data ED retrieved from the M buffer have already been known to the CPU 101. One of the tone generating channels is first assigned at step 601, and then the current time GT and pre-generation time ST are compared, so that the note-on process proceeds to step 605 if the pre-generation time ST is ahead of the current time GT, but, if the pre-generation time ST is not ahead of the current time GT (i.e., there is no previously-generated waveform data left), the process goes to step 603. Note that the pre-generation time ST is data indicating a particular time point up to which the previously-generated waveform data stored in the PC buffer are to be used.

If the event that the pre-generation time ST is ahead of the current time GT, this means that there is still the previously-generated waveform data left, the note-on process, at step 605, further determines whether note-on event timing preceding the current note-on event timing has already arrived and an additional waveform is now being added to the previously-generated waveform, i.e. whether or not the operations of steps 606 and 607 have already been carried out, in response to the preceding note-on event, for another tone generating channel than the currently-assigned tone generating channel and addition of a waveform is now being carried out. Namely, once the waveform addition is initiated, there would be caused a break in the generated tone unless the waveform addition is continued appropriately; thus, the determination of step 605 is made in order to allow the waveform addition to be executed with priority. If the waveform addition is in progress as determined at step 605, the note-on process goes to step 608, where the event data ED, reception time JT of the event data ED and the channel number of the assigned tone generating channel are stored into a T buffer so as to be placed in an additional-tone-generation start waiting state (i.e., execution of an instruction for the additional tone generation is waited). This is because the currently added waveform must be processed earlier. Note that the T buffer is provided in the first RAM 105 for storing the data placed in the additional-tone-generation start waiting state. After completion of step 608, the note-on process is brought to an end.

If, on the other hand, no waveform is being added as determined at step 605, the note-on process goes to step 606, where a waveform of the current note-on event is added. Namely, at step 606, tone generation control data for controlling a tone from an attack portion onward are set into a tone generation control register associated with the assigned tone generating channel when the time delay of the current time GT behind the pre-generation time ST is small, but tone generation control data for controlling the tone from sustain and subsequent portions are set into the tone generation control register when the time delay of the current time GT behind the pre-generation time ST is great. At next step 607, initiation of additional tone generation is instructed to the assigned tone generating channel. At this point, the current time GT is set to an addition time TT that is data indicative of a time point when addition of a new waveform to the previously-generated waveform data is to be started, and the channel number is set into a k register that is a working register provided for storing the channel number. After completion of step 607, the note-on process is brought to an end.

If there is no previously-generated waveform data left as determined at step 602, the note-on process goes to step 603 in order to add a waveform of the current note-on event. Namely, tone generation control data for controlling a tone from an attack portion onward are set into the tone generation control register associated with the assigned tone generating channel when the time delay of the current time GT behind the pre-generation time ST is small, but tone generation control data for controlling sustain and subsequent portions of the tone are set into the tone generation control register when the time delay of the current time GT behind the pre-generation time ST is great. At next step 604, initiation of normal tone generation is instructed to the assigned tone generating channel, and then the note-on process is brought to an end.

Note that the above-mentioned determination of the time delay when the tone control register data are set into the tone generation control register associated with the assigned tone generating channel may be made, for example, by comparing the current time GT and the reception time JT (that may be referred to as a time point when tone generation should be started, i.e. a tone-generation starting time) and judging the time delay to be "great" if the current time GT is behind the reception time JT by more than about 100 msec. but to be "small" if the current time GT is not behind the reception time JT by more than about 100 msec.

Figure 7:
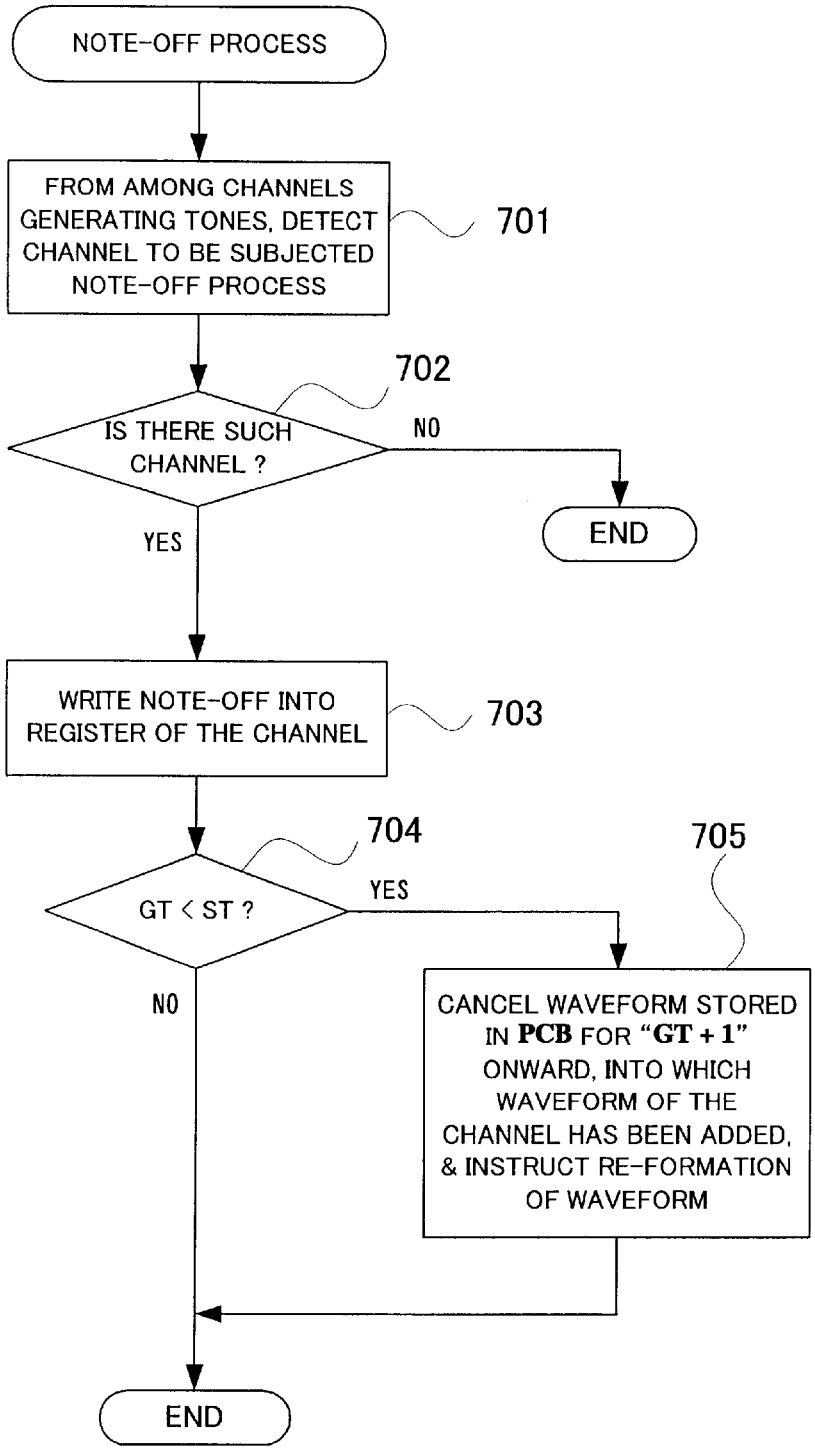
FIG. 7 is a flow chart showing a step sequence of a note-off process shown in FIG. 5.

FIG. 7 is a flow chart showing a step sequence of the note-off process carried out at step 504 of FIG. 5. At step 701, a tone generating channel to be subjected to a note-off operation, i.e. channel where a current generated tone is to be turned off, is detected from among all the channels currently generating tones. At step 702, a determination is made as to whether or not there is any tone generating channel to be subjected to the note-off operation. If answered in the negative at step 702, the input note-off event is ignored, and this note-off process is brought to an end without performing any other operations. If, however, there is such a tone generating channel to be subjected to the note-off operation, note-off event data is written into the tone control register associated with that channel. Then, at step 707, the current time GT and the pre-generation time ST are compared to each other. If there is previously-generated waveform data left as determined at step 704, the detected tone generating channel has to be changed to a note-off waveform in relation to the previously-generated waveform as well, so that the waveform stored in the PC buffer (PCB) for the current time "GT +1" onward, into which the waveform of the channel in question has been added, is canceled and re-formation of a waveform is instructed, at step 705. After that, the note-off process is brought to an end. If there is no previously-generated waveform data left as determined at step 704, the note-off process is immediately brought to an end without performing any other operation.

Figure 8:
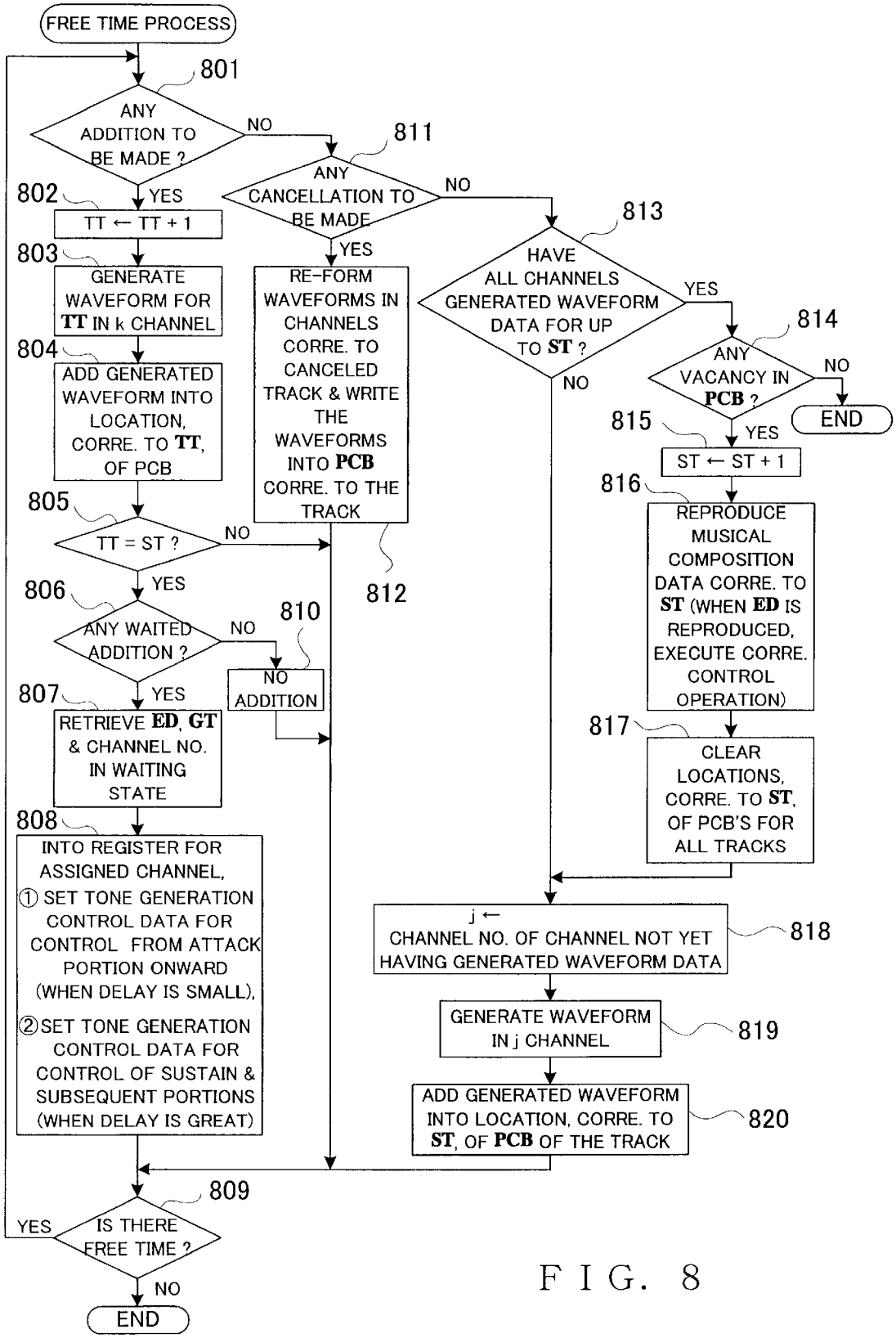
FIG. 8 is a flow chart showing an exemplary step sequence of a free time process shown in FIG. 3.

FIG. 8 is a flow chart showing an exemplary step sequence of the free time process carried out at step 308 in FIG. 3. First, at step 801, a determination is made as to whether there is any additional tone generation to be started (i.e. whether or not the instruction of step 607 of FIG. 6 has been given). If there is such additional tone generation to be started as determined at step 801, a value "1" is added to the addition time TT at step 802. At following step 803, a tone waveform is generated for the addition time TT in the k channel where the additional tone generation is to be initiated. Then, at step 804, the thus-generated tone waveform is added into a location, corresponding to the addition time TT, of the PC buffer (PCB) of the track where the tone waveform of that channel is to be added. At step 805, a determination is made as to whether the addition time TT and pre-generation time ST coincide or match with each other. If the addition time TT and pre-generation time ST match with each other as determined at step 805, there is no need to generate a subsequent tone waveform, the free time process goes to step 806, where a further determination is made with reference to the T buffer as to whether there is any waited additional tone generation (i.e., data set in the waiting state at step 608 above).

If there is such waited additional tone generation as determined at step 806, the free time process moves on to step 807, where the event data ED, current time GT and channel number of the assigned tone generating channel in the waiting state are retrieved from the T buffer and where the current time GT is set to the addition time TT and the channel number is set to the k register. If there is no such waited additional tone generation as determined at step 806, setting are made such that it is determined, in next execution of step 801, that there is no waited additional tone generation. Then, the free time process proceeds to step 809. At step 808 following step 807, tone generation control data for controlling a tone from an attack portion onward are set into the tone generation control register associated with the K channel (when the time delay is small), but tone generation control data for controlling the tone for sustain and subsequent portions thereof are set into the tone generation control register (when the time delay is great). At following step 809, it is determined whether or not there is free time. With an affirmative (YES) answer at step 809, the free time process reverts to step 801 to continue the process, while with a negative answer, the free time process is brought to an end without performing any other operation.

In case there is no additional tone generation to be started as determined at step 801, the free time process branches to step 811, where a further determination is made as to whether the waveform cancellation instruction has been given (at step 705) in the note-off process. If there has been such a waveform cancellation instruction as determined at step 811, waveforms for a plurality of channels corresponding to the canceled track are re-formed and written into the PC buffer corresponding to the same track at step 812. Similarly to the additional waveform generation, the waveform re-formation is performed by carrying out the re-formation operation a plurality of times. After step 812, the free time process goes to step 809.

If there has been no waveform cancellation instruction as determined at step 811, it is determined at step 813 whether waveform data for up to the pre-generation time ST (current waveform formation time) have been generated in all the tone generating channels concerned. With an affirmative answer at step 811, a further determination is made at step 814 as to whether or not there is a vacancy in the PC buffer (PCB). If there is no vacancy in the PC buffer, the free time process is brought to an end. However, if there is a vacancy in the PC buffer, the free time process proceeds to step 815 in order to add a value "1" to the pre-generation time ST, so that musical composition data corresponding to the pre-generation time ST are reproduced at step 816. When event data ED has been reproduced, this step 816 executes a corresponding control operation for reproduction of an automatic performance. For example, in the event that note-on event data is reproduced, step 816 assigns a tone generating channel to tone generation corresponding to the note-on event data, sets tone generation control data for the note-on event into the tone generation control register associated with the assigned channel, and instructs the tone generation. Further, in the event that note-off event data is reproduced, step 816 detects a tone generating channel currently generating the corresponding tone, and writes the note-off event data into the tone generation control associated with the detected channel. At next step 817, the locations, corresponding to the pre-generation time ST, of the PC buffers for all the tracks are cleared. This operation of step 817 is intended to clear all the PC buffers into which a waveform to be now formed should be written. After step 817, the free time process moves to step 818. If the waveform data have yet not been generated, in all the assigned tone generating channels, up to the pre-generation time ST as determined at step 813, the free time process also moves to step 818.

At step 818, the channel number of each tone generating channel not yet having generated the waveform data is set into a j register, so that a tone waveform is generated in the j channel at step 819. Then, at step 820, the thus-generated tone waveform is added into a location, corresponding to the pre-generation time ST, of the PC buffer of the track where the tone waveform of that channel is to be added. After that, the free time process goes to step 809.

Figure 9:
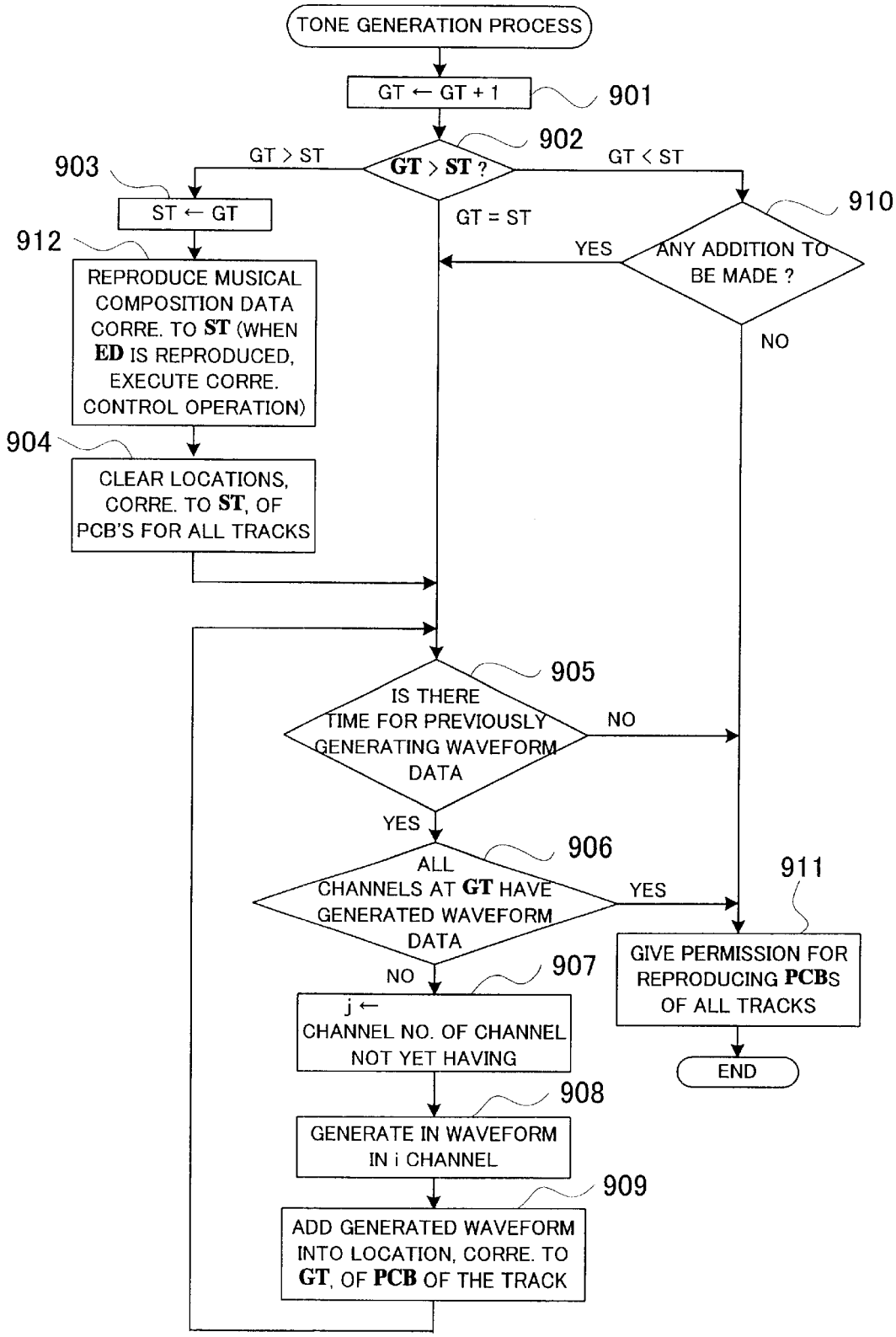
FIG. 9 is a flow chart showing an exemplary step sequence of a tone generation process shown in FIG. 3.

FIG. 9 is a flow chart showing an exemplary step sequence of the tone generation process carried out at step 307 in FIG. 3. First, at step 901, a value "1" is added to the current time GT. Then, at step 902, a comparison is made between the current time GT and the pre-generation time ST. If the current time GT is ahead of the pre-generation time ST, i.e. when there is no previously-generated waveform at all, then the current time GT is set to the pre-generation time ST at step 903. Musical composition data corresponding to the pre-generation time ST are reproduced at step 912, the locations, corresponding to the pre-generation time ST, the PC buffers for all the tracks are cleared at step 904, and then the tone generation process goes on to step 905. Note that the operation of step 912 is similar to the above-mentioned operation of step 816. If the current time GT and the pre-generation time ST match with each other as determined at step 902, the tone generation process also goes to step 905.

If the pre-generation time ST is ahead of the current time GT as determined at step 902, this means that there is a previously-generated waveform, so that the tone generation process branches to step 910, where a further determination is made as to whether another waveform cancellation instruction has been given (at step 705 of FIG. 7). If answered in the affirmative at step 902, this means that there is a need for another waveform change although the pre-generation time ST is ahead of the current time GT, the tone generation process goes to step 905 in order to generate a waveform corresponding to the instructed change. If, on the other hand, no other waveform cancellation instruction has been given as determined at step 910, this means that the previously-generated waveform has been completed, so that the tone generation process goes to step 911 in order to reproduce the previously-generated waveform as it is.

At step 905, it is further determined whether there is time for previously generating waveform data. If there is such time for previously generating waveform data, a further determination is made at step 906 as to whether or not waveform data have been generated in all the tone generating channels assigned at the current time GT. If there is no time for previously generating waveform data as determined at step 905, or if waveform data have been generated in all the tone generating channels assigned at the current time GT as determined at step 906, the tone generation process proceeds to step 911 in order to give permission for reproducing the PC buffers of all the tracks designated at the current time GT, after which the tone generation process is brought to an end. In the case where waveform data have not been generated in all the tone generating channels assigned at the current time GT as determined at step 906, the channel number of each tone generating channel having not yet generated the waveform data is set into an i register, so that a tone waveform is generated in the i channel at step 908. Then, at step 909, the thus-generated tone waveform is added into a location, corresponding to the current time GT, of the PC buffer where the tone waveform of that channel is to be added, after which the tone generation process revers to step 905. In accordance with the reproduction permission given at step 911, the waveform data for the current time GT stored in the PC buffer are transferred to the currently emptied P buffer for use in next waveform reproduction.

Automatic performance operation based on the musical composition data, carried out in the instant embodiment, is illustrated at step 816 of FIG. 8. In FIGS. 6 and 7, on the other hand, there are illustrated the note-on and note-off processes based on MIDI data that are input in real time. The operations of steps 905 to 909 in FIG. 9 and the operations of steps 812, 803, 804 and 818 to 820 in FIG. 8 are intended to generate tone waveform data on the basis of the tone generation control data for the tone generating channels that are set in the tone generation control registers in accordance with respective event data such as note-on event data.

In the above-described embodiment of the invention, a waveform is generated previously, or in advance, by the free time process, and when one of the two buffer storage sections of the P buffer has been emptied, the thus previously-generated waveform can be transferred to the P buffer for reproduction by the tone generation process. Then, even when there is not sufficient available time in the free time process and even where there has arisen such a situation or factor that disables or prevents waveform formation in necessary tone generating channels, a waveform is formed for each specific channel where the waveform formation process can be performed at all and added to the PC buffer, so that tone reproduction can be carried out using waveform data having been generated previously up to that time point. As a consequence, even when the waveform formation has been disabled or prevented for some reason, it is possible to reliably avoid an undesired break in any generated tone or noise production. Further, in the case where additional tone generation control data has been generated in relation to an already-previously-generated waveform, the described embodiment of the present invention forms an additional waveform corresponding to the additional tone generation control data and adds the additional waveform to the already-previously-generated waveform, so that the embodiment can appropriately deal with the additional tone generation just as instructed.

Further, when there has occurred such a situation or factor that disables or prevents the processing of note-on event data, for example, due to the fact that a further waveform addition is instructed after receipt of the preceding waveform addition instruction, the instant embodiment temporarily stores the instruction time and note-on data in the T buffer as data in the additional-tone-generation waiting state data (i.e., waits execution of the further waveform addition), and then performs the note-on process for the further waveform addition when the process becomes possible later. Thus, even when there has occurred a situation that disables or prevents the processing of note-on event data, as many additional processing as possible is carried out at a later stage.

Furthermore, the instant embodiment is arranged to detect, in response to each tone generation start instruction, a time delay of the current time from a time point when the tone generation should be started (tone-generation starting time), so that it generates a tone starting with the attack portion if the time delay is small but generates a tone starting with the sustain portion if the time delay is great. As a result, the instant embodiment of the present invention can reliably avoid unnatural tones.

As having been described so far, the present invention is characterized in that a waveform is generated previously or in advance using free time (i.e., when no other process is being performed) so that when there has occurred a situation preventing waveform generation, the waveform data having been previously generated by that time can be output. Thus, even when the waveform formation has been disabled or prevented due to excessively-increased loads on a processor or other reason in a real-time system, the present invention can reliably avoid unnatural tone control, such as an undesired break in a generated tone or noise production. Further, with the arrangement that when there has occurred a situation that disables or prevents tone generation processing responsive to a received tone generation instruction, the received tone generation instruction is temporarily waited and then executed when the tone generation processing becomes possible at a later time, the present invention can process as many additional operations as possible at the later time, and hence can minimize or eliminate a need for discarding the tone generation instruction. Furthermore, the present invention is characterized by detecting a time delay of a current time from a tone-generation starting time and generating a tone starting with the attack portion if the time delay is small but generating a tone starting with the sustain portion if the time delay is great. As a result, the present invention can reliably avoid unnatural tones.

What is claimed is:

1. A tone generation method for implementation by use of an apparatus including a processor that executes software, a storage section storing waveform generation software to be executed by said processor, and a buffer storage section that stores waveform data generated by execution of the waveform generation software, said tone generation method comprising:

a step of receiving a tone generation instruction;

a step of causing said processor to execute the waveform generation software on the basis of the tone generation instruction received via said step of receiving, to thereby not only generate and output waveform data but also previously generate waveform data to be output later than a current time point;

a step of storing, into said buffer storage section, the waveform data generated previously via said step of causing;

a step of, when there has occurred a situation that prevents waveform generation, outputting the previously-generated waveform data currently stored in said buffer storage section;

a step of waiting execution of the tone generation instruction, when there has occurred a situation that prevents previous generation of waveform data based on the tone generation instruction; and a step of generating waveform data based on the tone generation instruction waited by said step of waiting, when the generation of waveform data based on the tone generation instruction becomes possible later.

2. A tone generation method as claimed in claim 1 wherein in tone generation based on the waveform generation software, a current time and a tone-generation starting time are compared, and wherein waveform data starting with an attack portion of a tone are generated when a time delay of the current time from the tone-generation starting time is smaller than a predetermined value, but waveform data starting with a sustain portion of the tone are generated when the time delay of the current time from the tone-generation starting time is greater than a predetermined value.

3. A tone generation method for implementation by use of an apparatus including a processor that executes software, a storage section storing waveform generation software to be executed by said processor, and a buffer storage section that stores waveform data generated by execution of the waveform generation software, said tone generation method comprising:

a step of receiving a tone generation instruction;

a step of causing said processor to execute the waveform generation software on the basis of the tone generation instruction received via said step of receiving, to thereby not only generate and output waveform data but also previously generate waveform data to be output later than a current time point;

a step of storing, into said buffer storage section, the waveform data generated previously via said step of causing; and a step of generating waveform data for current and subsequent time points on the basis of the received tone generation instruction and adding the generated waveform data for the current and subsequent time points to the waveform data generated previously via said step of causing and stored in said buffer storage section.

4. A tone generation method as claimed in claim 3 wherein in tone generation based on the waveform generation software, a current time and a tone generation start time are compared, and wherein waveform data starting with an attack portion of a tone are generated when a time delay of the current time from the tone-generation starting time is smaller than a predetermined value, but waveform data starting with a sustain portion of the tone are generated when the time delay of the current time from the tone generation starting time is greater than a predetermined value.

5. A tone generation method for implementation by use of an apparatus including a processor that executes software, a storage section storing waveform generation software to be executed by said processor, and a buffer storage section that stores waveform data generated by execution of the waveform generation software, said tone generation method comprising:

a step of receiving a tone generation instruction;

a step of causing said processor to execute the waveform generation software on the basis of the tone generation instruction received via said step of receiving, thereby generating waveform data in a plurality of channels, and mixing the waveform data, generated in the plurality of channels, on a track-by-track basis to thereby output the mixed waveform data for each of the tracks;

a step of previously generating waveform data for a plurality of channels to be output later than a current time point and mixing the waveform data, previously generated in the plurality of channels, on a track-by-track basis to thereby store, into said buffer storage section, the mixed waveform data for each of the tracks; and a step of, when there has occurred a situation that prevents waveform generation, outputting the previously-generated waveform data currently stored in said buffer storage section.

6. A tone generation method as claimed in claim 5 which further comprises a step of receiving track control data, and wherein the waveform data for each of the tracks stored in said buffer storage section are controlled on the basis of the track control data.

7. A tone generation method as claimed in claim 5 wherein said step of previously generating waveform data previously generates the waveform data on the basis of a tone generation start instruction received by said step of receiving prior to a current tone generation start instruction.

8. A tone generation method as claimed in claim 5 wherein said step of previously generating waveform data previously generates the waveform data on the basis of musical composition data to be automatically performed.

9. A tone generation method as claimed in claim 5 wherein in tone generation based on the waveform generation software, a current time and a tone generation start time are compared, and wherein waveform data starting with an attack portion of a tone are generated when a time delay of the current time from the tone-generation starting time is smaller than a predetermined value, but waveform data starting with a sustain portion of the tone are generated when the time delay of the current time from the tone generation starting time is greater than a predetermined value.

10. A tone generation apparatus comprising:

a storage section storing waveform generation software;

a processor coupled with said storage section and capable of executing the waveform generation software; and a buffer storage section coupled with said processor and arranged to store waveform data generated by said processor executing the waveform generation software, wherein said processor is adapted to:

receive a tone generation instruction;

execute the waveform generation software on the basis of the received tone generation instruction, to thereby not only generate and output waveform data but also previously generate waveform data to be output later than a current time point;

store, into said buffer storage section, the previously-generated waveform data;

when there has occurred a situation that prevents waveform generation, output the previously-generated waveform data currently stored in said buffer storage section;

wait execution of the tone generation instruction when there has occurred a situation that prevents previous generation of waveform data based on the tone generation instruction; and generate waveform data based on the waited tone generation instruction when the generation of waveform data based on the tone generation instruction becomes possible later.

11. A tone generation apparatus comprising:

a storage section storing waveform generation software;

a processor coupled with said storage section and capable of executing the waveform generation software; and a buffer storage section coupled with said processor and arranged to store waveform data generated by said processor executing the waveform generation software, wherein said processor is adapted to:

receive a tone generation instruction;

execute the waveform generation software on the basis of the received tone generation instruction, to thereby not only generate and output waveform data but also previously generate waveform data to be output later than a current time point;

store, into said buffer storage section, the previously-generated waveform data; and generate waveform data for current and subsequent time points on the basis of the received tone generation instruction and add the generated waveform data for the current and subsequent time points to the waveform data previously generated and stored in said buffer storage section.

12. A tone generation apparatus comprising:

a storage section storing waveform generation software;

a processor coupled with said storage section and capable of executing the waveform generation software; and a buffer storage section coupled with said processor and arranged to store waveform data generated by said processor executing the waveform generation software, wherein said processor is adapted to:

receive a tone generation instruction;

execute the waveform generation software on the basis of the received tone generation instruction to thereby generate waveform data in a plurality of channels, and mix the waveform data, generated in the plurality of channels, on a track-by-track basis to thereby output the waveform data for a plurality of tracks;

previously generate waveform data for a plurality of channels to be output later than a current time point and mix the waveform data, previously generated in the plurality of channels, on a track-by-track basis to thereby generate waveform data for a plurality of tracks and store, into said buffer storage section, the waveform data for each of the plurality of tracks; and when there has occurred a situation that prevents waveform generation, output the previously-generated waveform data currently stored in said buffer storage section.

13. A machine-readable storage medium containing a group of instructions to cause said machine to perform a tone generation method, said tone generation method being implemented by use of an apparatus comprising a storage section storing waveform generation software, a processor capable of executing the waveform generation software, and a buffer storage section that stores waveform data generated by said processor executing the waveform generation software, said tone generation method comprising:

a step of receiving a tone generation instruction;

a step of causing said processor to execute the waveform generation software on the basis of the tone generation instruction received via said step of receiving, to thereby not only generate and output waveform data but also previously generate waveform data to be output later than a current time point;

a step of storing, into said buffer storage section, the waveform data generated previously via said step of causing;

a step of, when there has occurred a situation that prevents waveform generation, outputting the previously-generated waveform data currently stored in said buffer storage section;

a step of waiting execution of the tone generation instruction, when there has occurred a situation that prevents previous generation of waveform data based on the tone generation instruction; and a step of generating waveform data based on the tone generation instruction waited by said step of waiting, when the generation of waveform data based on the tone generation instruction becomes possible later.

14. A machine-readable storage medium containing a group of instructions to cause said machine to perform a tone generation method, said tone generation method being implemented by use of an apparatus comprising a storage section storing waveform generation software, a processor capable of executing the waveform generation software, and a buffer storage section that stores waveform data generated by said processor executing the waveform generation software, said tone generation method comprising:

a step of receiving a tone generation instruction;

a step of causing said processor to execute the waveform generation software on the basis of the tone generation instruction received via said step of receiving, to thereby not only generate and output waveform data but also previously generate waveform data to be output later than a current time point;

a step of storing, into said buffer storage section, the waveform data generated previously via said step of causing; and a step of generating waveform data for current and subsequent time points on the basis of the received tone generation instruction and adding the generated waveform data for the current and subsequent time points to the waveform data generated previously via said step of causing and stored in said buffer storage section.

15. A machine-readable storage medium containing a group of instructions to cause said machine to perform a tone generation method, said tone generation method being implemented by use of an apparatus comprising a storage section storing waveform generation software, a processor capable of executing the waveform generation software, and a buffer storage section that stores waveform data generated by said processor executing the waveform generation software, said tone generation method comprising:

a step of receiving a tone generation instruction;

a step of causing said processor to execute the waveform generation software on the basis of the tone generation instruction received via said step of receiving, thereby generating waveform data in a plurality of channels, and mixing the waveform data, generated in the plurality of channels, on a track-by-track basis to thereby output waveform data for a plurality of tracks;

a step of previously generating waveform data for a plurality of channels to be output later than a current time point and mixing the waveform data, previously generated in the plurality of channels, on a track-by-track basis to thereby generate waveform data for a plurality of tracks and store, into said buffer storage section, the waveform data for each of the plurality of tracks; and a step of, when there has occurred a situation that prevents waveform generation, outputting the previously-generated waveform data currently stored in said buffer storage section.

* * * * *